US008685208B2

(12) United States Patent
Viljanmaa et al.

(10) Patent No.: US 8,685,208 B2
(45) Date of Patent: Apr. 1, 2014

(54) ARRANGEMENT FOR TREATING FIBER WEB

(71) Applicants: Mika Viljanmaa, Helsinki (FI); Topi Tynkkynen, Vantaa (FI)

(72) Inventors: Mika Viljanmaa, Helsinki (FI); Topi Tynkkynen, Vantaa (FI)

(73) Assignee: Valmet Technologies, Inc., Espoo (FI)

( * ) Notice: Subject to any disclaimer, the term of this patent is extended or adjusted under 35 U.S.C. 154(b) by 0 days.

(21) Appl. No.: 13/773,445

(22) Filed: Feb. 21, 2013

(65) Prior Publication Data

US 2013/0220565 A1 Aug. 29, 2013

(30) Foreign Application Priority Data

Feb. 28, 2012 (EP) ..... 12157278

(51) Int. Cl.
*D21F 3/02* (2006.01)

(52) U.S. Cl.
USPC ..... 162/205; 162/361

(58) Field of Classification Search
USPC ..... 162/205, 361
See application file for complete search history.

(56) References Cited

U.S. PATENT DOCUMENTS

| | | | |
|---|---|---|---|
| 2,237,068 | A | 4/1941 | Bradner |
| 4,391,217 | A | 7/1983 | Koski |
| 5,830,275 | A | 11/1998 | Reich |
| 6,599,395 | B2 | 7/2003 | Wulz et al. |
| 7,591,898 | B2 | 9/2009 | Damrau et al. |
| 2005/0271821 | A1 | 12/2005 | Lee et al. |
| 2008/0087216 | A1 | 4/2008 | Damrau et al. |

FOREIGN PATENT DOCUMENTS

| | | | |
|---|---|---|---|
| CN | 201099804 | | 8/2008 |
| DE | 3146519 | A1 | 6/1982 |
| DE | 4415581 | A1 | 1/1995 |
| DE | 19704858 | A1 | 8/1998 |
| WO | 03004770 | A1 | 1/2003 |
| WO | 2006058961 | A1 | 6/2006 |
| WO | 2006070064 | A1 | 7/2006 |

OTHER PUBLICATIONS

European Search Report for EP1215278 dated Jul. 3, 2012.

*Primary Examiner* — Mark Halpern
(74) *Attorney, Agent, or Firm* — Stiennon & Stiennon

(57) ABSTRACT

An arrangement for treating a fiber web, in particular for sizing paper and board web (W), using a sizer (10) which has sizing equipment (3, 4) located on both sides of the web (W) and size press rolls (5, 6) located on both sides of the web (W) in between of which a size nip is formed. The web (W) when approaching the sizer (10) is first guided past the size nip of the sizer (10) in a process direction (D) and then is turned into an opposite direction (OD) in relation to the process direction (D) by at least one turning guide roll (15) such that the top side (TS) of the web (W) is sized by sizing equipment (4) located below the web (W).

21 Claims, 4 Drawing Sheets

ARRANGEMENT FOR TREATING FIBER WEB

CROSS REFERENCES TO RELATED APPLICATIONS

This application claims priority on European Application No. EP12157278, filed Feb. 28, 2012, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an arrangement for treating a fiber web. Particularly, but not solely, the invention relates to an arrangement for sizing paper and board web, in particular for sizing paper and board web. Especially the invention relates to an arrangement for treating a fiber web, where a sizer has sizing equipment located on both sides of the web and size press rolls located on both sides of the web and between which a size nip is formed.

The sizing of paper and board web typically utilizes a separate sizer. In connection with the sizer different kinds of sizing technology are employed in prior art arrangements, for example pond sizing technology or film transfer technology or spray sizing technology. WO publication 03/004770 A1 discloses a further method for manufacturing a surface sized web of paper of paperboard, the method comprising a step of applying to at least one side of the web an aqueous furnish of size and according to the method the solids content of the size furnish being applied is at least 15% and the size furnish is applied to one side of the web by an amount not greater than 5 $g/m^2$ as aqueous furnish of size applied to the web. As one suitable, among others, applicator apparatus for the method disclosed, the publication mentions spray applicators. Further, WO publication 2006/058961 A1 discloses a method and arrangement for processing a paper or board web or similar fiber web. In this prior art method a processing mixture is spread on the surface of the web with spray nozzles. In the method the web to be processed is lead from a press nip and between rolls in this nip. Before the web enters the nip such an amount of processing mixture is spread onto at least one side of the web so that the processing mixture is still wet when it enters the nip. In the prior art arrangement according to this publication the arrangement comprises at least one press nip, elements for taking the web to the press nip, and elements for spreading the processing mixture, wherein the elements for spreading the processing mixture are spray nozzles which are arranged at an adjustable distance in the arrival direction of the web from the press nip to feed the processing mixture to at least one surface of the web.

A typical web transfer route according to the prior art in connection with spray sizing apparatuses is shown schematically in FIG. 1. The fiber web W is guided by guide rolls 1, 2 to the sizer 10, comprising spray sizing equipments 3, 4 and size press rolls 5, 6 forming a size nip and which rolls 5, 6 are located on both sides of the web W. After the spray sizing equipments 3, 4 the web W is guided into the size nip i.e. size press of the sizer 10, which sizer press comprises two size press rolls 5, 6 between which the size nip is formed. In the production line the fiber web W is produced such that the front side of the finished web W is the side shown in the figure as top side TS of the web W and in the figure the bottom side BS of the web W will be the back side of the finished web product. By front side of the finished product is meant the side that, for example in a final product made of the fiber web such as a cardboard box, is on the outside and thus in the view of the customer. Thus it is required of the fiber web production that the side of the web that will be the front side of the finished web product must be free from defects and of prefect quality, but, on the other hand, the side of the web that will be the back side of the finished web product may contain defects as it is not in view on the product. One problem in prior art web transfer in connection with the sizer 10 comprising spray sizing apparatuses is that sometimes the spray sizing equipment 4 located above the web i.e. on the top size of the web W might drop size droplets on the top of the web thus creating a defect to the front side of the final product.

CN utility model 201099804 discloses a mica paper gluing machine, which comprises a roller guide apparatus arranged at the back of a mica paper roll. A guide roll is used in the machine to change the transfer direction of the web.

A film coater is disclosed in US patent application publication 2008/0087216 in which one or more coaters are utilized to transfer coating to the outer surfaces of at least one more rolls, which in turn transfer the coating from the roll surfaces to one or more sides of the web for coating paper. The web runs upwardly past a guide roll and into and through the nip where the film of coating is applied to the outer surface of each roll by a corresponding coating applicator and is transferred to a corresponding side of the web. While film split action may occur, the resulting film droplets fall back onto the roll surfaces and not onto the web as would result if the web would run downwardly.

This has been tried to be solved in the prior art by arranging the web transfer route to be vertical via the spray equipment, but this vertical transfer is problematic in some cases because an air drying device remains between sizer frames.

SUMMARY OF THE INVENTION

An object of the present invention is to create an arrangement for treating fiber web in which the problems of prior art arrangements relating to the defects caused by the droplets dropping from the sizing equipment are eliminated or at least minimized.

Another object of the present invention is to create an arrangement for minimizing space requirements of the arrangement.

In order to solve the mentioned problems and to achieve the mentioned objects the invention is mainly characterized by an arrangement in which, when approaching the sizer, the web is first guided past the sizer nip of the sizer in the process direction and then the transfer direction of the web is turned into the opposite direction in relation to the process direction by a turning guide roll such that the top side of the web, which is the side that in the final product made of the fiber web is on the outside and thus in the view of the customer, is sized by sizing equipment located below the web.

According to the present invention the arrangement for treating fiber webs has a sizer comprising sizing equipments and a size nip arranged in between two sizing press rolls. According to the invention the web is, when approaching the sizer area, first guided past the size nip of the sizer in the process direction and then the transfer direction is turned in the opposite direction in relation to the process direction such that the top side of the web will be the bottom side during sizing. The fiber web is guided to the sizing by at least one turning guide roll that is arranged to turn the web such that when the web reaches the sizing equipment the side of the web that will be the front side of the finished web product is sized by the sizing equipment located below the web, i.e. the lower sizing equipment. By this web transfer route droplets dropping from the sizing equipment do not drop on the side of the web that will be the front side of the finished web product and the possible droplets from the upper equipment will drop on the side of the web that will be the back side of the finished web product.

According to one aspect of the invention in an arrangement with an upper transfer route to the sizer, the web is lead to the sizer such that after at least one guide roll directing the transfer direction forwards and upwards, the transfer route is turned to be substantially horizontal and the web is directed over and past the size nip of the sizing equipment and then the web transfer route is turned with a turning guide roll so that the main transfer direction is opposite to the process direction and in particular backwards and downwards through the sizer.

According to another aspect of the invention which uses an arrangement with a lower transfer route, the web is lead in the process direction to the sizer such that first the web is guided substantially horizontally past the size nip and under the sizer and then by at least one turning guide roll the web is turned such that the direction of the web transfer is opposite to the process direction and in particular backwards and upwards through the sizer.

Advantageously, after the sizer a non-contacting turning device is arranged to turn the web transfer route back to forwards and into the direction required by the process.

According to another advantageous feature the web is guided directly from the latter size press roll to the following process and with the help of at least one guide roll into the direction required by the process.

According to one advantageous embodiment of the invention the sizing equipment is spray sizing equipment. According to another advantageous embodiment of the invention the sizing equipment located below the web is pond sizing equipment and the sizing equipment located above the web is spray sizing equipment. According to another advantageous embodiment of the invention the sizing equipment located below the web is film sizing equipment and the sizing equipment located above the web is spray sizing equipment.

The arrangement according to the invention is also very well suited for modernization of an already existing sizer as no extra space is required for the turning guide roll that provides for the turning of the web route for sizing.

The invention is advantageous in modernizing purposes since already existing devices can be utilized.

One further advantage of the present invention is that the transfer route will provide for longer spreading time for the web which in turn is better in view of the runnability of the web.

The arrangement according to the invention is most advantageously used when producing fiber web grades that are used in finished product such that only one side of the web product is in view. The grades most advantageously produced utilizing the invention are one-sided printing paper grades, testliner, folding box board, copy paper, coated fine paper, fluting and in particular one-sided special paper grades.

BRIEF DESCRIPTION OF THE DRAWINGS

In the following the invention will be described in more detail by reference to some advantageous examples of the invention presented in the accompanying drawings.

DESCRIPTION OF THE PREFERRED EMBODIMENTS

In the figures the same reference signs are used for corresponding parts and components of the arrangement unless otherwise mentioned.

Figure 1:
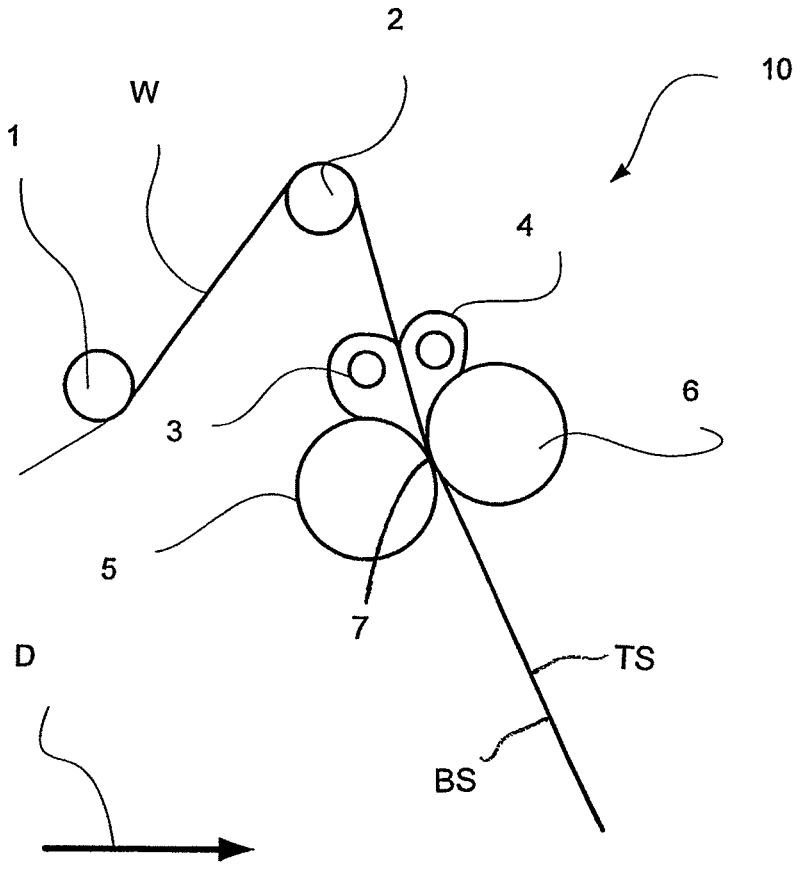
Fig. 1 prior art
FIG. 1 shows schematically one arrangement according to the prior art.

In FIG. 1 a typical example of a prior art arrangement is shown. In this example the fiber web W is guided in approach to the sizer 10, comprising spray sizing equipments 3, 4 located on both sides of the web W and size press rolls 5, 6, by guide rolls 1, 2 so that the web W approaches the sizer 10. After the spray sizing equipments 3, 4 of the sizer 10 the web W is guided into the size press of the sizer 10, which sizer press comprises two size press rolls 5, 6 between which the size nip 7 is formed. In the production line the fiber web W is produced such that the front side of the finished web W is the side shown in the figure as the top side TS of the web W, and the bottom side BS of the web W will be the back side of the finished web product.

Figure 2:
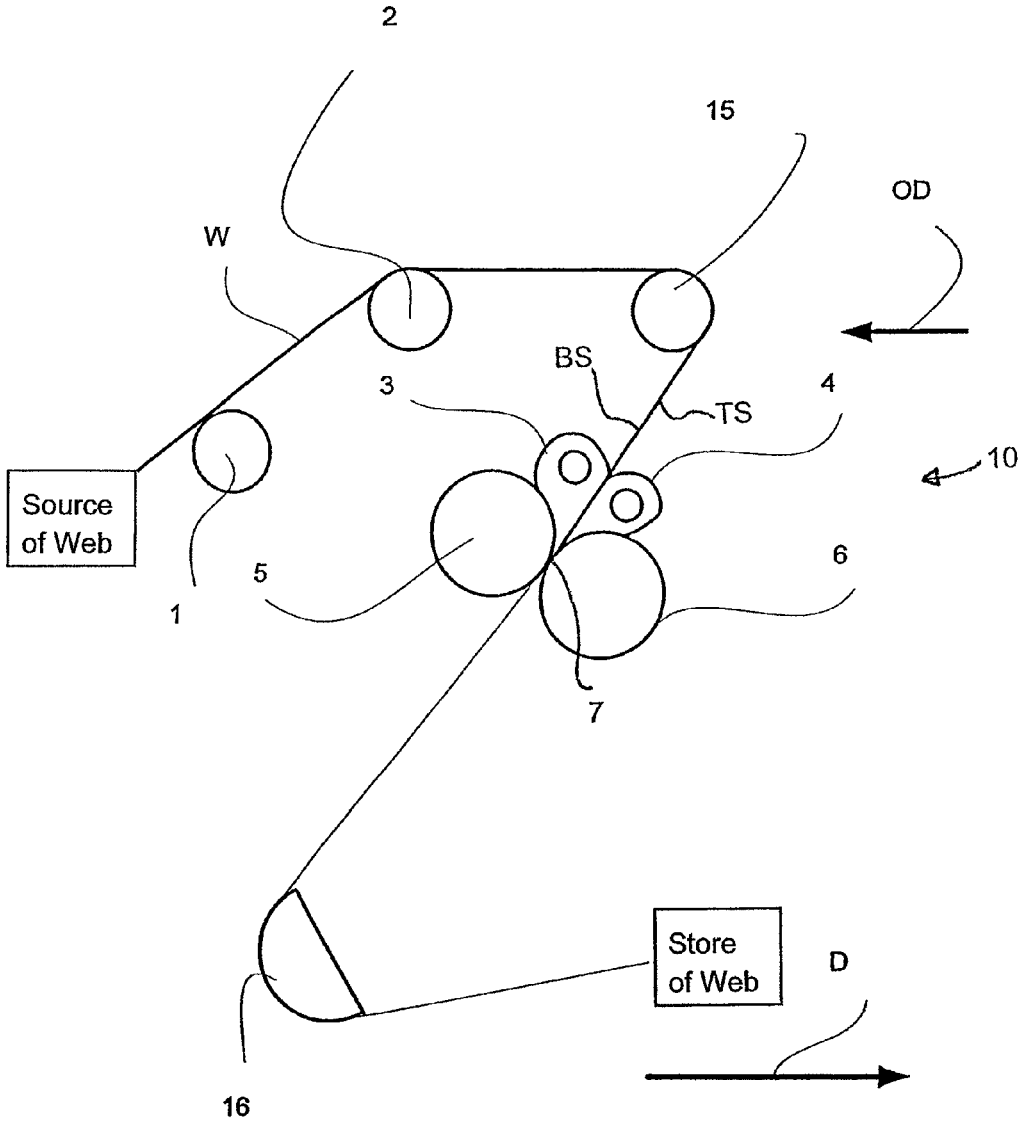
FIG. 2 shows schematically one example of an arrangement according to the invention.

In FIG. 2 a process direction D is the machine direction defined between a source of web and a store of web, so that the process direction D is the overall direction the web moves as it approaches to the sizer and passes through to where it is ultimately stored in a roll or the like. In the example of FIG. 2 the sizer 10 comprises spray sizing equipments 3, 4 located on both sides of the web W and size nip 7 between size press rolls 5, 6 also located on both sides of the web. According to the invention the web W is, when approaching area of the sizer 10 guided by the guide rolls 1, 2, first guided past the size nip 7 of the sizer 10 in the process direction D to at least one turning guide roll 15 and then the transfer direction of the web W is turned into the opposite direction OD in relation to the process direction D such that the top side TS of the web W will be the lower side during sizing and the bottom side BS of the web will be the upper side of the web W during sizing. The fiber web W is thus guided to the sizing by at least one turning guide roll 15 that is arranged to turn the web such that when the web W reaches the spray sizing equipments 3, 4 the top side TS of the web W that will be the front side of the finished web product is sized by the spray sizing equipment 4 located below the web W, i.e. the lower spray sizing equipment 4, and the bottom side BS of the web W that will be the back side of the finished web product is sized by the spray sizing equipment 3 located above the web W, i.e. the upper spray sizing equipment 3. After the sizing with the spray sizing equipment, the web W is guided through the size press formed in between the two size press rolls 5, 6. In the arrangement of FIG. 2, the upper transfer route to the sizer of the web is utilized which means that the web W is lead to the sizer 10 such that after the guide rolls 1, 2, which direct the transfer direction forwards and upwards, the transfer route is turned to be substantially horizontal and the web W is directed over and past the size nip 7 of the sizer 10 and then the web transfer route is turned with a turning guide roll 15 so that the direction is in the opposite direction OD in relation to the process direction D and in particular backwards and downwards through the sizer. The inclination angle is advantageously 0-45 degrees. After the sizer 10 a non-contacting turning device 16, for example a blow turning device, is arranged to turn the web W transfer route back to the process direction D forward and into the direction required by the process.

Figure 3:
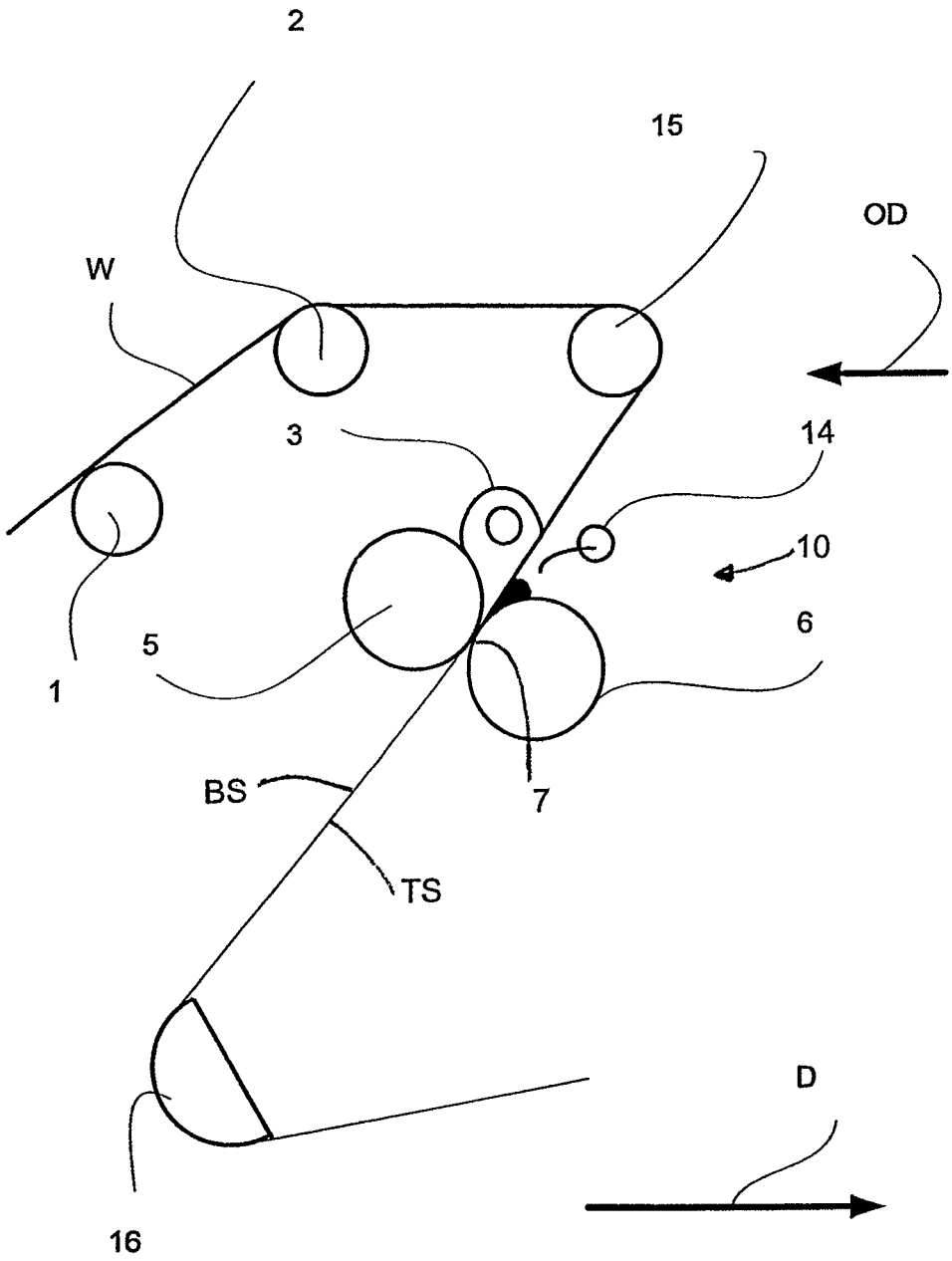
FIG. 3 shows schematically another example of an arrangement according to the invention.

In the example of FIG. 3 the sizer 10 comprises sizing equipments 3, 14 located on both sides of the web W and a size nip 7 between the size press rolls 5, 6 also located on both sides of the web. The sizing equipment 14 located below the web W, i.e. the lower sizing equipment 14, is pond sizing equipment, and the sizing equipment 3 located above the web W, i.e. upper sizing equipment 3, is spray sizing equipment. According to the invention, the web W is, when approaching the area of the sizer 10, guided by guide rolls 1, 2, first guided past the size nip 7 of the sizer 10 in the process direction D to at least one turning guide roll 15 and then the transfer direction of the web W is turned into the opposite direction OD in relation to the process direction D such that the top side TS of the web W will be the lower side during sizing and the bottom side BS of the web the upper side of the web W during sizing. The fiber web W is thus guided to the sizing by at least one turning guide roll 15 that is arranged to turn the web such that when the web W reaches the sizing equipments 3, 14 the top side TS of the web W, that will be the front side of the finished web product, is sized by the pond sizing equipment 14 located below the web W, i.e. the lower sizing equipment 14 and the bottom side BS of the web W that will be the back side of the finished web product is sized by the spray sizing equipment 3 located above the web W, i.e. upper spray sizing equipment 3. After the sizing with sizing equipment, the web W is guided through the size press formed in between two size press rolls 5, 6. In this arrangement of FIG. 3, the upper transfer route to the sizer of the web is utilized, which means that the web W is lead to the sizer 10 such that after at least one guide roll 1, 2 directing the transfer direction forwards and upwards, the transfer route is turned to be substantially horizontal and the web W is directed over and past the size nip 7 of the sizer 10 and then the web transfer route is turned with a turning guide roll 15 so that the direction is the opposite direction OD in relation to the process direction D and in particular backwards and downwards through the sizer. After the sizer 10 a non-contacting turning device 16, for example a blow turning device is arranged to turn the web W transfer route back to the process direction and forward and into the direction required by the process.

Figure 4:
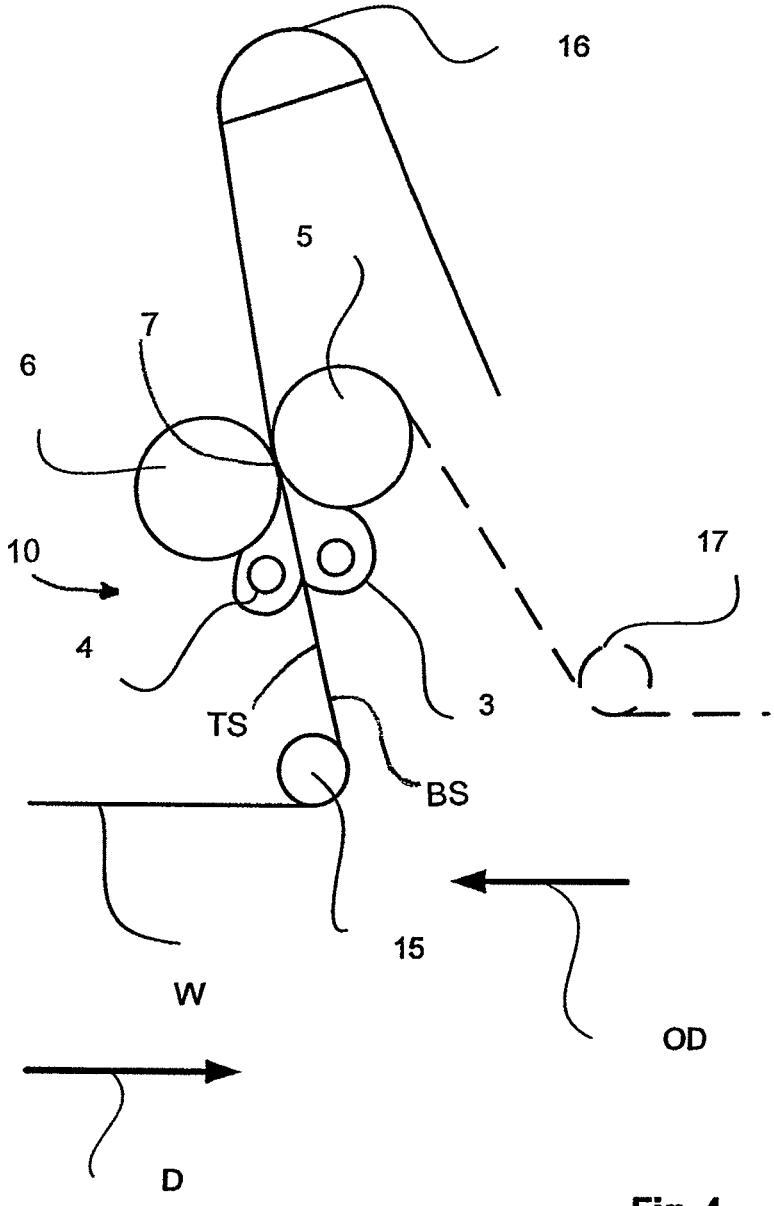
FIG. 4 shows schematically a further example of an arrangement according to the invention.

In the example of FIG. 4 the sizer 10 comprises spray sizing equipment 3, 4 located on both sides of the web W and a size nip 7 between size the press rolls 5, 6 also located on both sides of the web. According to the invention the web W is, when approaching the area of the sizer 10, first guided past the sizer 10 in the process direction D to at least one turning guide roll 15 and then the transfer direction of the web W is turned into the opposite direction OD in relation to the process direction D such that the top side TS of the web W will be the lower side during sizing and the bottom side BS of the web will be the upper side of the web W during sizing. The fiber web W is thus guided to the sizing by at least one turning guide roll 15 that is arranged to turn the web such that when the web W reaches the spray sizing equipments 3, 4 the top side TS of the web W that will be the front side of the finished web product is sized by the spray sizing equipment 4 located below the web W, i.e. the lower spray sizing equipment 4, and the bottom side BS of the web W that will be the back side of the finished web product is sized by the spray sizing equipment 3 located above the web W, i.e. the upper spray sizing equipment 3. After the sizing with the spray sizing equipment, the web W is guided through the size press nip 7 formed in between two size press rolls 5, 6. In this example of an arrangement with a lower transfer route, the web W is lead in the process direction D to the sizer 10 such that first the web is guided substantially horizontally past the size nip and under the sizer 10, and then by at least one turning guide roll 15 the web is turned such that the direction of the web transfer is in the opposite direction OD to the process direction D and in particular backwards and upwards. After the sizer 10 a non-contacting turning device 16, for example a blow turning device, is arranged to turn the web W transfer route back to the process direction and forward and into the direction required by the process. In an alternative transfer route, shown in FIG. 4 by a dashed line, the web W is guided directly from the latter size press roll 5 to the following process and with the help of a guide roll 17 into the direction required by the next process step.

The invention has been explained with reference to some advantageous examples but is not limited to these examples only. Many variations and modifications are possible within the scope of the invention.

We claim:

1. An arrangement for sizing paper or board web, comprising:

a sizer which comprises sizing equipment located on both sides of a web and size press rolls located on both sides of the web, the size press rolls forming a size nip therebetween;

wherein the sides of the web comprise a top side, and a bottom side;

wherein a process direction is defined which extends from a source of the web to a store of the web;

wherein the sizing equipment located on both sides of the web comprises a sizing equipment above the web and a sizing equipment below the web;

wherein the web is arranged to approach the sizer by extending along a path past the sizer nip of the sizer in the process direction and then the web extends about at least one turning guide roll and extends in a direction opposite the process direction such that the top side of the web is positioned to be sized by the sizing equipment located below the web so that the top side will be less prone to receive drips from the sizing equipment located below the web and the web top side will have fewer defects and so the top side in a final product made of the fiber web when placed on an outside of an object has fewer defects in view.

2. The arrangement of claim 1 wherein the path of the web extends to the sizer along at least one guide roll directing the web path in the process direction and upwardly above the sizer, the web path then turns so as to extend to be substantially horizontal and the web then extends over and past the size nip of the sizer and then the web path extends about a turning guide roll so that the web after the turning roll extends in the direction opposite the process direction and downwardly such that the web extends through the sizer downwardly in a backward direction such that the top side of the web is positioned to be sized by the sizing equipment located below the web.

3. The arrangement of claim 2 wherein the sizing equipment located below the web and the sizing equipment located above the web are located above the size nip.

4. The arrangement of claim 1 wherein the web path extends from below the sizer in the process direction substantially horizontally past and below the size nip and the sizer, and then extends to at least one turning guide roll and after the at least one turning guide roll the web extends such that the web extends substantially in a backward direction and upwardly and through the sizer such that the top side of the web is positioned to be sized by the sizing equipment located below the web.

5. The arrangement of claim 4 wherein the sizing equipment located below the web and the sizing equipment located above the web are located below the size nip.

6. The arrangement of claim 1 wherein after the sizer the web path extends about a non-contacting turning device arranged to turn the web path back to the process direction toward the store of web.

7. The arrangement of claim 6 wherein the non-contacting turning device is a blow turning device.

8. The arrangement of claim 1 wherein the size press rolls comprise a first press roll and a later press roll which is downstream in the process direction from the first press roll, and the web path extends directly from the latter size press roll to a guide roll and then to the store of web.

9. The arrangement of claim 1 wherein the web is of a fiber web grade used in a finished product such that only one side of the web product is in view.

10. The arrangement of claim 1 wherein the sizing equipments located on both sides of the web are spray sizing equipments.

11. The arrangement of claim 3 wherein the sizing equipment located below the web is pond sizing equipment and the sizing equipment located above the web is spray sizing equipment.

12. The arrangement of claim 1 wherein the sizing equipment located below the web is film sizing equipment and the sizing equipment located above the web is spray sizing equipment.

13. An arrangement for sizing paper or board web, comprising:

a web having a top side, and a bottom side, the web defining a process direction as it extends from a source of web into and out of a sizer to a store of web;

wherein the sizer has sizing equipment located on both sides of a web, comprising a sizing equipment above the web and a sizing equipment below the web, and wherein size press rolls are located on both sides of the web, the size press rolls forming a size nip therebetween, the size press rolls comprising a first press roll and a later press roll which is downstream in the process direction from the first press roll;

wherein the web is arranged to approach the sizer by extending along a path past the sizer nip of the sizer in the process direction and then extends about at least one turning guide roll and extends in a backward direction opposite the process direction such that the top side of the web is positioned to be sized by the sizing equipment located below the web so that the top side will be less prone to receive drips from the sizing equipment located below the web and the web top side will have fewer defects and so the top side in a final product made of the fiber web when placed on an outside of an object has fewer defects in view.

14. The arrangement of claim 13 wherein the sizing equipment located below the web and the sizing equipment located above the web are located above the size nip; and wherein the path of the web extends to the sizer along at least one guide roll directing the web path in the process direction and upwardly above the sizer, the web path then turns so as to extend to be substantially horizontal and the web then extends over and past the size nip of the sizer and then the web path extends about a turning guide roll so that the web after the turning roll extends in the backward direction opposite the process direction and downwardly such that the web extends through the sizer downwardly in the backward direction such that the top side of the web is positioned to be sized by the sizing equipment located below the web.

15. The arrangement of claim 13 wherein the sizing equipment located below the web and the sizing equipment located above the web are located below the size nip; and wherein the web path extends from below the sizer in the process direction substantially horizontally past and below the size nip and the sizer, and then extends to at least one turning guide roll and after the at least one turning guide roll the web extends such that the web extends substantially in the backward direction and upwardly and through the sizer such that the top side of the web is positioned to be sized by the sizing equipment located below the web.

16. The arrangement of claim 13 wherein after the sizer the web path extends about a non-contacting turning device arranged to turn the web path back to the process direction in the direction of store of web.

17. The arrangement of claim 13 wherein the web path extends directly from the latter size press roll to a guide roll and then to the store of web.

18. The arrangement of claim 14 wherein the sizing equipment located below the web is pond sizing equipment and the sizing equipment located above the web is spray sizing equipment.

19. A method for sizing paper or board web, comprising:

passing a web having a top side and a bottom side through a sizer so the web passes through the sizer in a process direction as the web travels from a source of web into and out of the sizer to a store of web;

conducting the web toward the sizer in the process direction so the web travels past a size nip formed between a first press roll and a later press roll of the sizer;

turning the web about at least one turning guide roll;

passing the web through the size nip in a backward direction opposite the process direction;

sizing the bottom side of the web with sizing equipment located above the web before the size nip;

sizing the top side of the web with sizing equipment located below the web and before the size nip so that the top side is less prone to receiving drips from the sizing equipment below the web than the bottom side of the web is to receive drips from the sizing equipment above the web, so the web top side has fewer defects than the web bottom side and using the web in a product so the top side is placed on an outside of an object and has fewer defects in view.

20. The method of claim 19 wherein the sizing equipment located below the web and the sizing equipment located above the web are located above the size nip; and wherein the web travels to the sizer along at least one guide roll directing the web in the process direction and upwardly above the sizer;

turning the web with a guide roll(s) so the web travels substantially horizontally past the size nip of the sizer;

turning the web about at least one turning guide roll and passing the web through the size nip downwardly and in the backward direction.

21. The method of claim 19 wherein the sizing equipment located below the web and the sizing equipment located above the web are located below the size nip; and wherein the web travels below the sizer in the process direction substantially horizontally past and below the size nip and the sizer; and turning the web about the at least one turning guide roll and passing the web through the size nip in upwardly and in the backward direction.

* * * * *